US005729898A

United States Patent [19]

Ogawa

[11] Patent Number: 5,729,898

[45] Date of Patent: Mar. 24, 1998

[54] METHOD OF MAKING ELECTRICAL SOCKET

[75] Inventor: Shinji Ogawa, Yokkaichi, Japan

[73] Assignee: Sumitomo Wiring Systems, Ltd., Japan

[21] Appl. No.: 611,076

[22] Filed: Mar. 5, 1996

[30] Foreign Application Priority Data

Apr. 28, 1995 [JP] Japan ..... 7-128989

[51] Int. Cl.[6] ..... H01R 43/20

[52] U.S. Cl. ..... 29/883; 29/884; 264/272.17

[58] Field of Search ..... 29/883, 884; 264/272.17

[56] References Cited

U.S. PATENT DOCUMENTS

| | | | |
|---|---|---|---|
| 4,380,119 | 4/1983 | Normann et al. | 29/884 |
| 4,859,890 | 8/1989 | Nishimura | 29/883 X |
| 4,910,867 | 3/1990 | Weigert | 264/272.17 X |
| 5,444,910 | 8/1995 | Pesson et al. | 29/883 X |

FOREIGN PATENT DOCUMENTS

| | | |
|---|---|---|
| 186085 | 6/1989 | Japan . |
| 317429 | 4/1991 | Japan . |

*Primary Examiner*—Carl J. Arbes

*Attorney, Agent, or Firm*—Jordan B. Bierman; Bierman, Muserlian and Lucas LLP

[57] ABSTRACT

A method of making an electrical socket having an insertion part, a receptacle, and an electrically conductive terminal therebetween. The insertion part and the receptacle are at an angle to each other and the conductive terminal is bent at substantially the same angle. A tubular member is molded and one end of the conductive terminal is inserted through an insertion hole in the closed end so that the other end projects therefrom. This end is bent, preferably to a 90° angle with the remainder of the conductive terminal, thereby forming the core member. The core member is inserted into a mold whereby, when molding resin is introduced into said mold, the outer tube and the receptacle are integrally formed.

5 Claims, 6 Drawing Sheets

METHOD OF MAKING ELECTRICAL SOCKET

This Application claims the priority of Japanese Application 7-128,989, filed Apr. 28, 1995.

BACKGROUND OF THE INVENTION

1. Field of the Invention

The present Invention relates to an L-shaped socket comprising a part for insertion of an electrical unit and a receptacle for connection to a source of power or another electrical unit, as well as a method for the production thereof. The electrical unit is preferably a light bulb, and the socket finds its principal use in automotive vehicles, particularly in the trunks or tail lights. For ease of explanation, the Invention will be described as a bulb-receiving socket, but it is understood that this use is exemplary only.

2. Description of the Prior Art

For the bulb sockets to be used in automotive vehicles, the projection rearward must be as small as possible, in view of restrictions on the installation space. For this purpose there has been known a device wherein the system is formed in an L-shape (hereinafter to be referred to as an L-socket). The bulb socket comprises a synthetic resin socket body and a bulb to be set therein. In an L-socket, the socket body also has an L-shape, so that it is difficult physically to provide a method of inserting a metal terminal after formation of the body. Accordingly, assembly of the terminal by insert molding has been considered.

However, in insert molding, the metal terminal is applied to a metal mold, and the molten resin is injected therein. It is necessary to mold the socket body so that no resin impinges on the terminal; hence, the mold must have a part which covers the terminal. However, the fitting used for a wedge base bulb (a type common in this field) often has a complicated configuration. Accordingly, the mold to be used in conjunction with such a terminal must have a similarly complicated structure, leading to an increase in the mold cost. Additionally, if the shape of the terminal is complicated, increased variation in size will result so that it may be impossible to completely cover the insert molding satisfactorily. In such a case, there is concern that the molten resin will enter terminal cavity and interfere with the flow of current.

There has also been known a method of inserting an L-shaped metal terminal into the socket body without resorting to insert molding. For example, the terminal is provided in two pieces, i.e. the bulb holding part and an electric supply part (the latter to be connected to the power source), which are joined together after insertion (see Japanese Utility Model Laid-open Publication HEI 1-86085). Alternatively, a notched slit is formed on the socket body to permit the L-shaped terminal to be inserted therein.

However, the former system requires a complicated metal terminal in that it must be in two pieces; further, a device permitting the connection of the pieces is also required. The latter method is inadequate when waterproofing is considered, because a slit for insertion is formed and remains open after completion. Heretofore, an optimum method for producing an L-shaped socket and terminal has not been developed.

Therefore, it is an object of the present Invention to provide an L-shaped socket which is easy to manufacture and to also provide a method for production thereof.

SUMMARY OF THE INVENTION

The present Invention is a method which comprises molding a tubular member having, at its closed end, a surface, a terminal insertion hole through which the metal terminals can be inserted, the tubular member having an open end opposite the closed end. A supply contact of the terminal is inserted through the insertion hole so that it projects outward; thereafter, the projecting portion is bent into an L-shape, thereby forming a core member which includes the metal terminal. Then the core member is inserted into a metal mold for secondary molding to form the insertion part and the receptacle for the supply contact.

The bulb socket comprises a socket body which has a bulb inserting part and a receptacle in an L-shaped configuration. The metal terminals are in the socket body with a bulb receiver within the bulb inserting part and the supply terminal within the receptacle. In other words, the socket body corresponds in its L-shape to the L-shaped metal terminal. There is an outer shell separately formed around the outer periphery of the core and the receptacle extends integrally therefrom. In a preferred form of the Invention, the supply contact to be bent into the L-shape is a single plate, which facilitates the operation. Moreover, because the outer shell etc. is formed by molding as a separate body, there is no necessity to cover the metal terminal while doing so; therefore, the molding is effected with a metal mold of simple structure.

According to the Invention, the tubular body is first formed, after which the metal terminal is introduced and the supply terminal thereof is passed through, and extends from, the terminal insertion hole. Then, by bending the supply contact into the L-shape, the core member containing the metal terminal is obtained. Thereafter, the core is placed in a metal mold for secondary molding, wherein the outer tube, outer shell, and receptacle are formed, thereby producing the socket of the predetermined configuration.

After forming the tubular member, the metal terminal is inserted to form the core member, followed by molding of the remaining parts of the socket. Thus, it is unnecessary to have a special portion of the mold to cover the metal terminal and prevent entry of resin. Accordingly, the structure of the metal mold can be simplified without the risk of impairing the electric current carrying ability of the terminal metal fitting due to intrusion of molding resin into the cavity in the tubular member. Furthermore, because the bent part of the terminal is a single plate, the force needed for bending can be small whereby the bending work is facilitated.

BRIEF DESCRIPTION OF THE DRAWINGS

In the accompanying drawings, constituting a part hereof, and in which like reference characters indicate like parts.

DETAILED DESCRIPTION OF THE PREFERRED EMBODIMENTS

Figure 1:
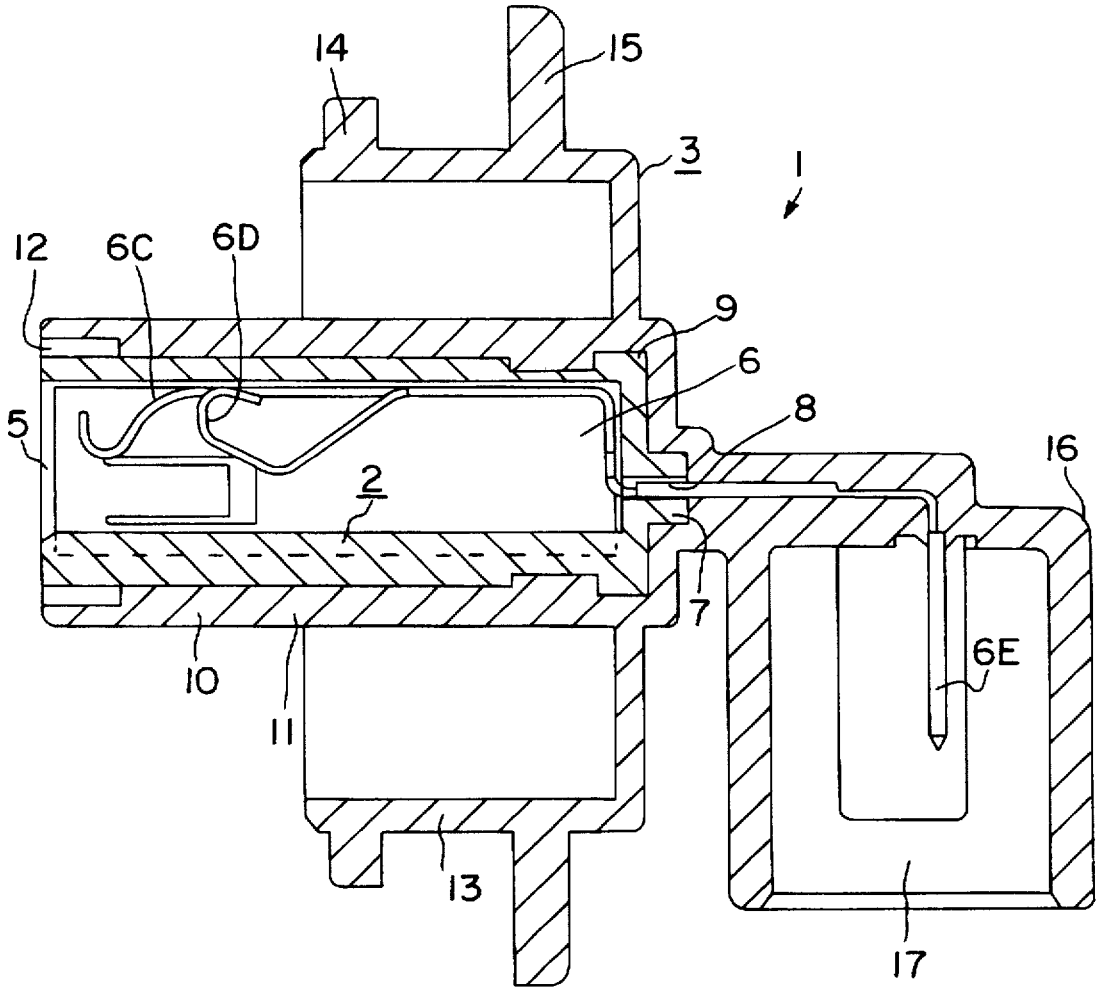
FIG. 1 is a sectional view of the socket of the present Invention.
Figure 2:
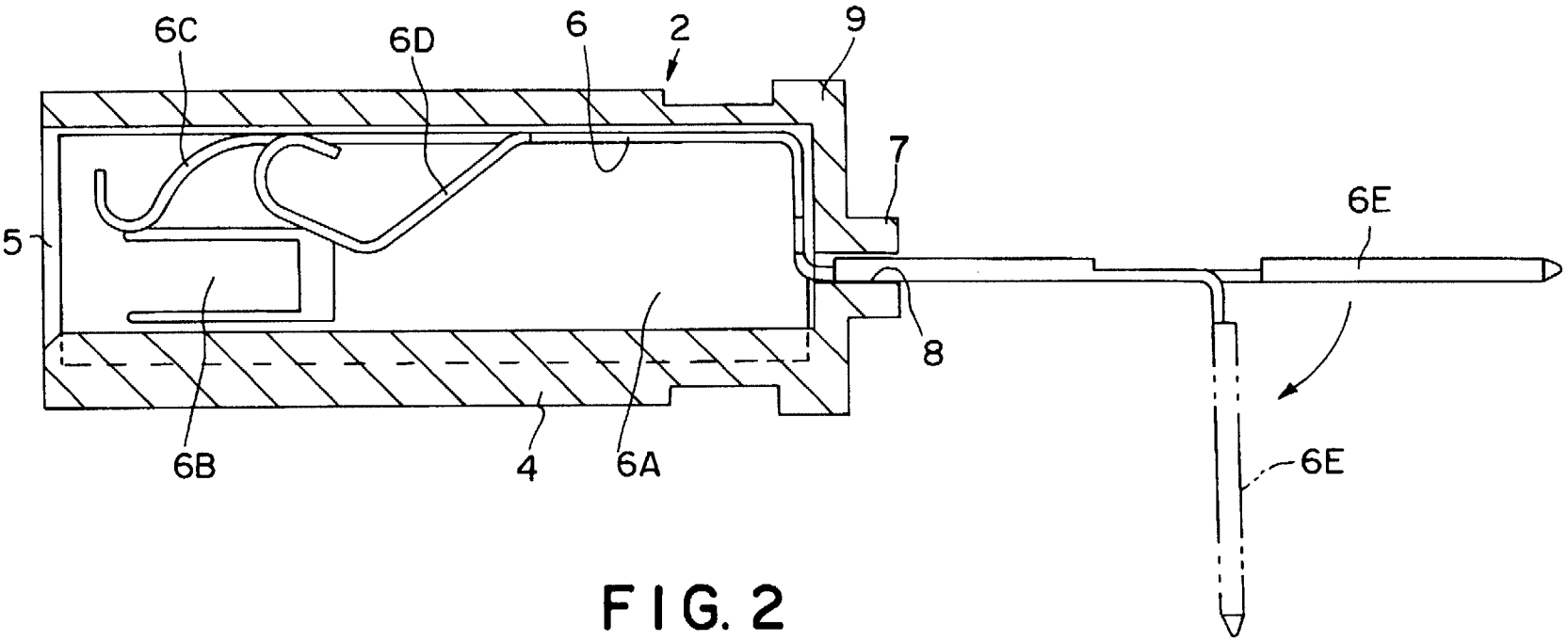
FIG. 2 is a sectional view taken along the line II—II of FIG. 3, showing the core.
Figure 3:
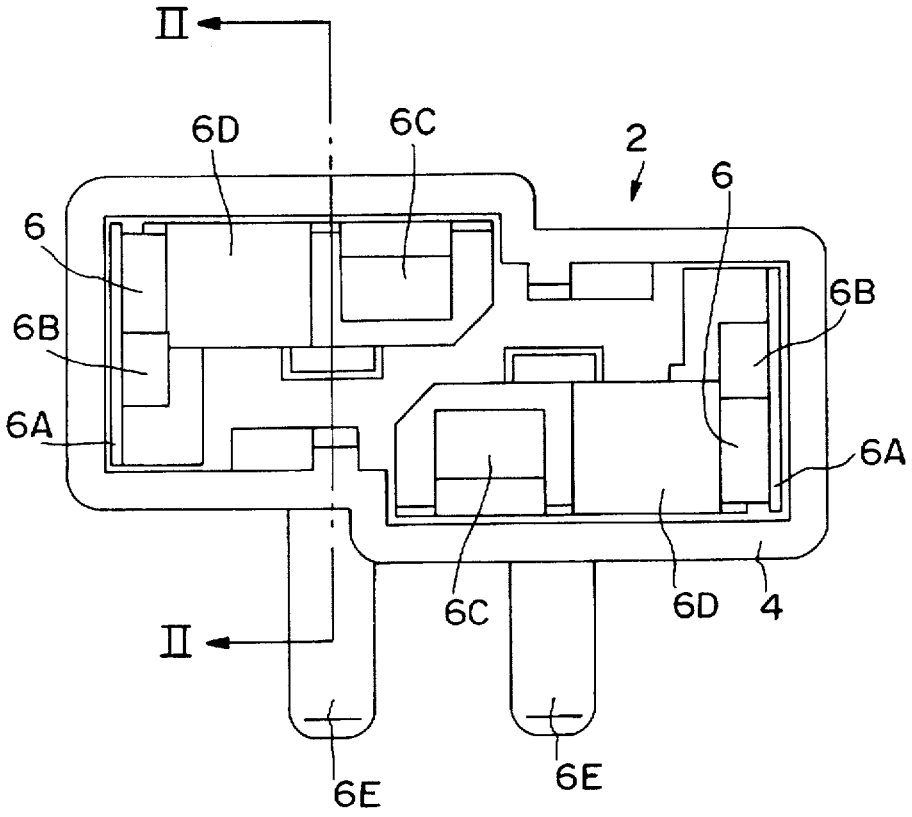
FIG. 3 is a front elevation of the core member.
Figure 4:
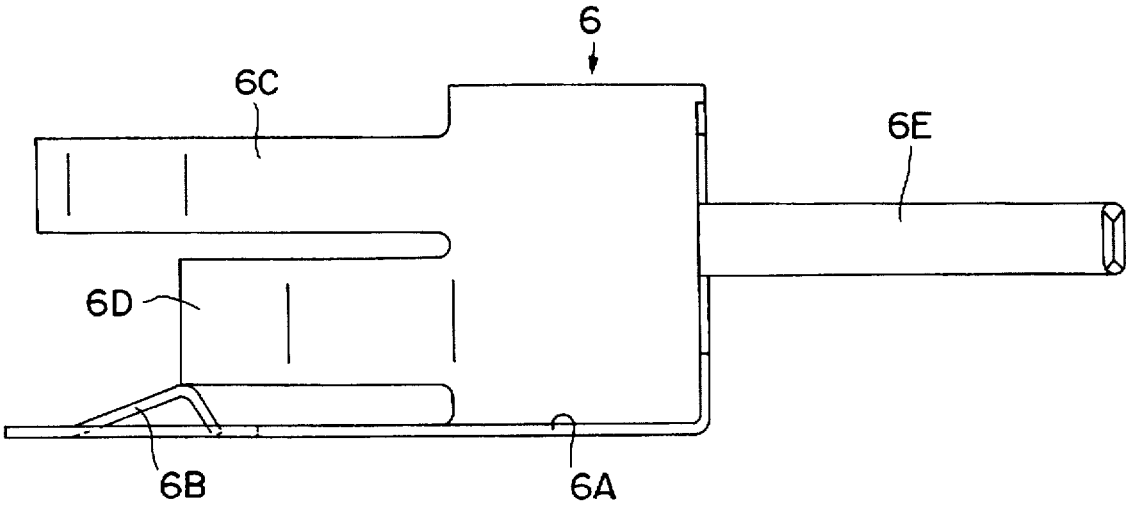
FIG. 4 is a side view of the metal terminal.
Figure 5:
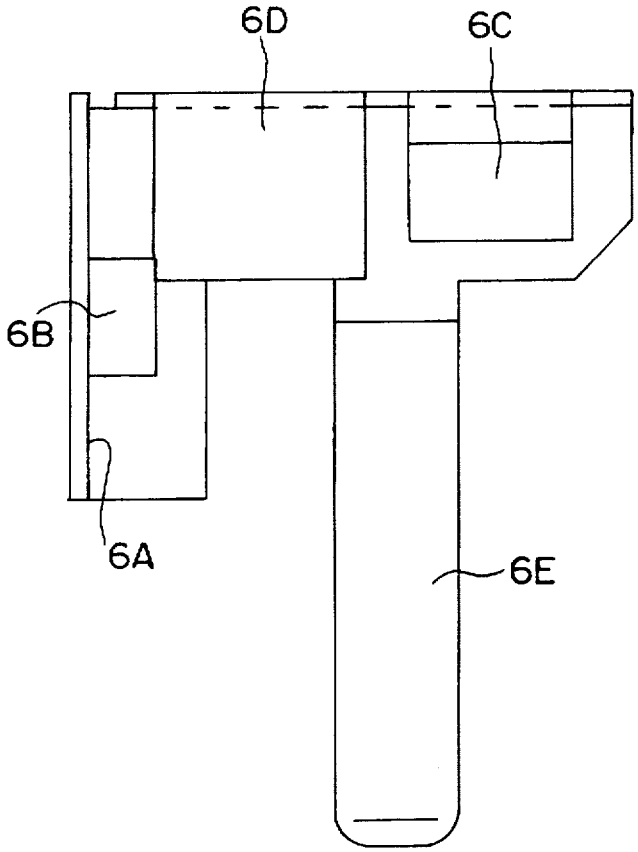
FIG. 5 is a front view of the metal terminal.

Socket 1 comprises core member 2 fitted with metal terminal 6 formed by a primary molding and outer shell 3 formed by a secondary molding in which core member 2 is inserted. Core member 2 comprises tubular member 4 made of synthetic resin (e.g. nylon) and metal terminal 6 pressed therein. Tubular member 4 is preferably a straight square tube open to the left side as shown in FIGS. 1 and 2. This opening is bulb insertion port 5. Tubular member 4 preferably accommodates two terminals therein. Projection 7 is formed on the outer surface of the closed end of tubular member 4 and a pair of terminal insertion holes 8, corresponding to the metal terminals, is provided therein. Supply contact 6E of terminal 6 can then be inserted through, so that it projects from, insertion hole 8 without a gap. Further, tubular member 4 has, adjacent its remote end, flange 9, which extends around the entire circumference of member 4; this provides a mechanical stop when engaging outer shell 3.

Figure 6:
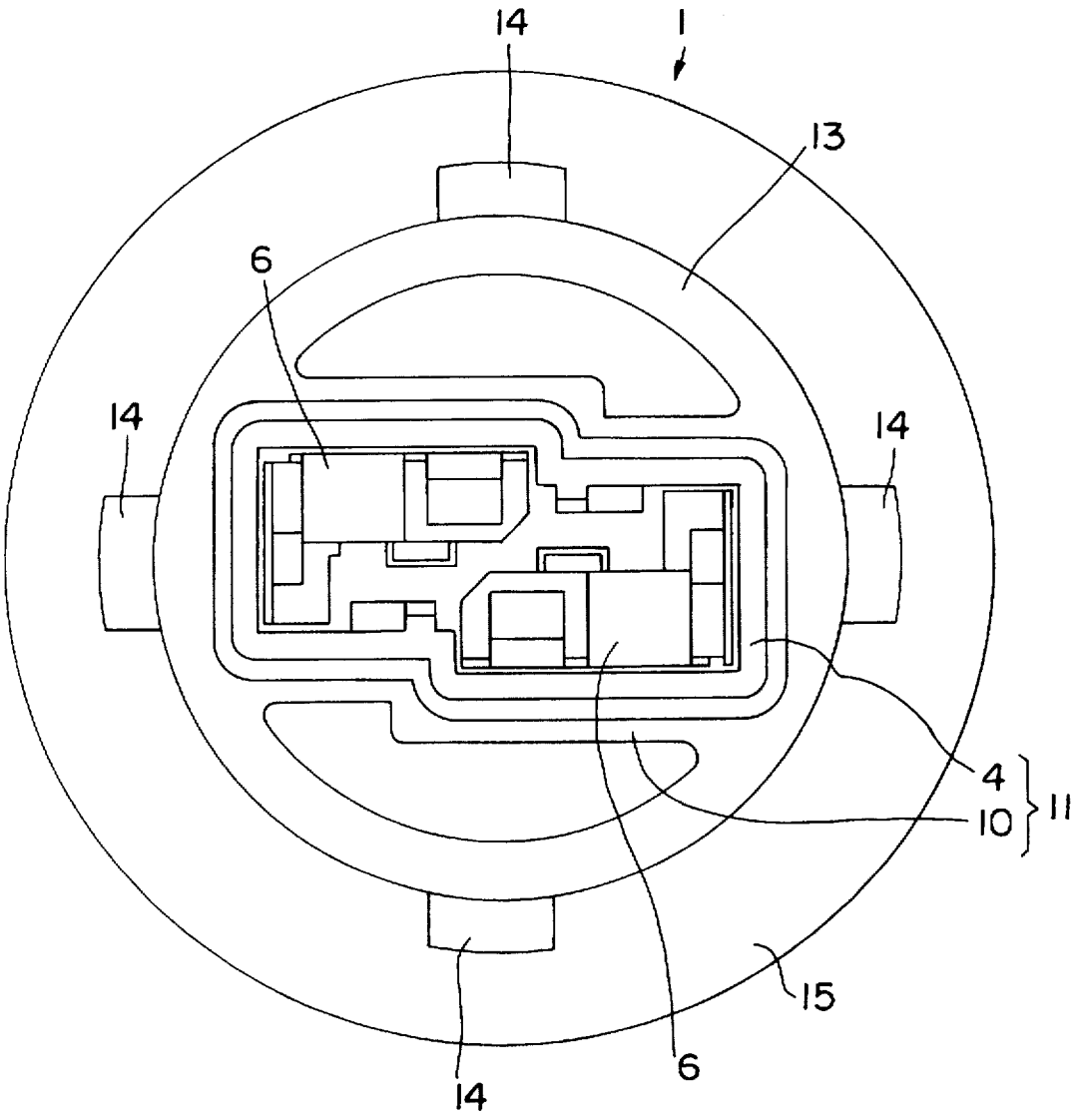
FIG. 6 is a front view of the bulb socket.

Each terminal 6 is formed by bending a conductive metal plate. It comprises wall plate 6A along the surface of the inner wall of tubular member 4 and includes presser 6B formed by cutting and deforming the plate inward. Being in direct contact with the narrow side of a wedge base bulb, it can restrict movement of the bulb in the right-left direction as shown in FIG. 6. At right angles to a lateral side end of wall plate 6A, are long elastic stop 6C and short elastic terminal 6D parallel to each other. The former engages a non-illustrated wedge base bulb to provide a stop therefor. Elastic terminal 6D elastically contacts the two electrodes of the wedge base bulb.

Furthermore, from the end at which elastic stop 6C and electric terminal 6D are formed, the material is bent inward at right angles, and further bent outward at right angles to form supply contact 6E. This supply contact 6E at first is straight so that it can be inserted into insertion hole 8 of tubular member 4. Thereafter, the contact is bent at right angles as shown by the broken lines in FIG. 2. Further, with respect to supply contact 6E, the part to be enclosed in insertion hole 8 and the part which forms the connection with the source of electricity are bent together in tight contact from both sides to form double layers for improved strength. However, the portion between these parts is left as a single plate to facilitate bending thereof.

Outer shell 3 is of the same quality resin as tubular member 4, and has tubular outer tube 10 surrounding the outer side and remote end surfaces thereof; thus constituting outer part 11. Between the open end of outer tube 10 and the open end of tubular member 4, thin groove 12 is formed around the entire periphery. This prevents molten resin from entering tubular member 4 during the molding of outer shell 3. Around outer tube 10 and integral therewith, there is provided cylinder 13, adjacent the remote end and extending toward, but short of, the open end. On the outer periphery of cylinder 13, and adjacent the end thereof opposite the remote end, there are four projections 14 at equal angular distances from each other; nearer to the remote end, flange 15 projects radially outwardly around the entire periphery.

At the closed end of outer tube 10, there is provided receptacle 16 for insertion of a connector for the source of electricity. Receptacle 16 is disposed so that its axis and that of insertion port 11 are at approximately a right angle to each other. Cylinder 13, at its front end (remote from the closed end) connector insertion port 17 (to receive a connector for the power supply) is located. Within receptacle 16, supply contact 6E of metal terminal 6 projects.

To produce socket 1, tubular member 4 is molded in a first, primary molding step. Two supply contacts 6E are inserted through corresponding terminal insertion holes 8 to extend into receptacle 17. Insertion holes 8 are designed to fit tightly around metal terminal 6 to create a watertight seal.

Thereafter, the distal end of supply contact 6E is bent as shown in phantom lines in FIG. 2. Since the intermediate portion of contact 6E between the proximal and distal ends thereof is a single layer, the bending can be easily carried out, thereby forming core member 2. Thus, there is no need for terminal 6 to be formed in two parts and, accordingly, they do not have to be connected together during assembly.

Figure 7:
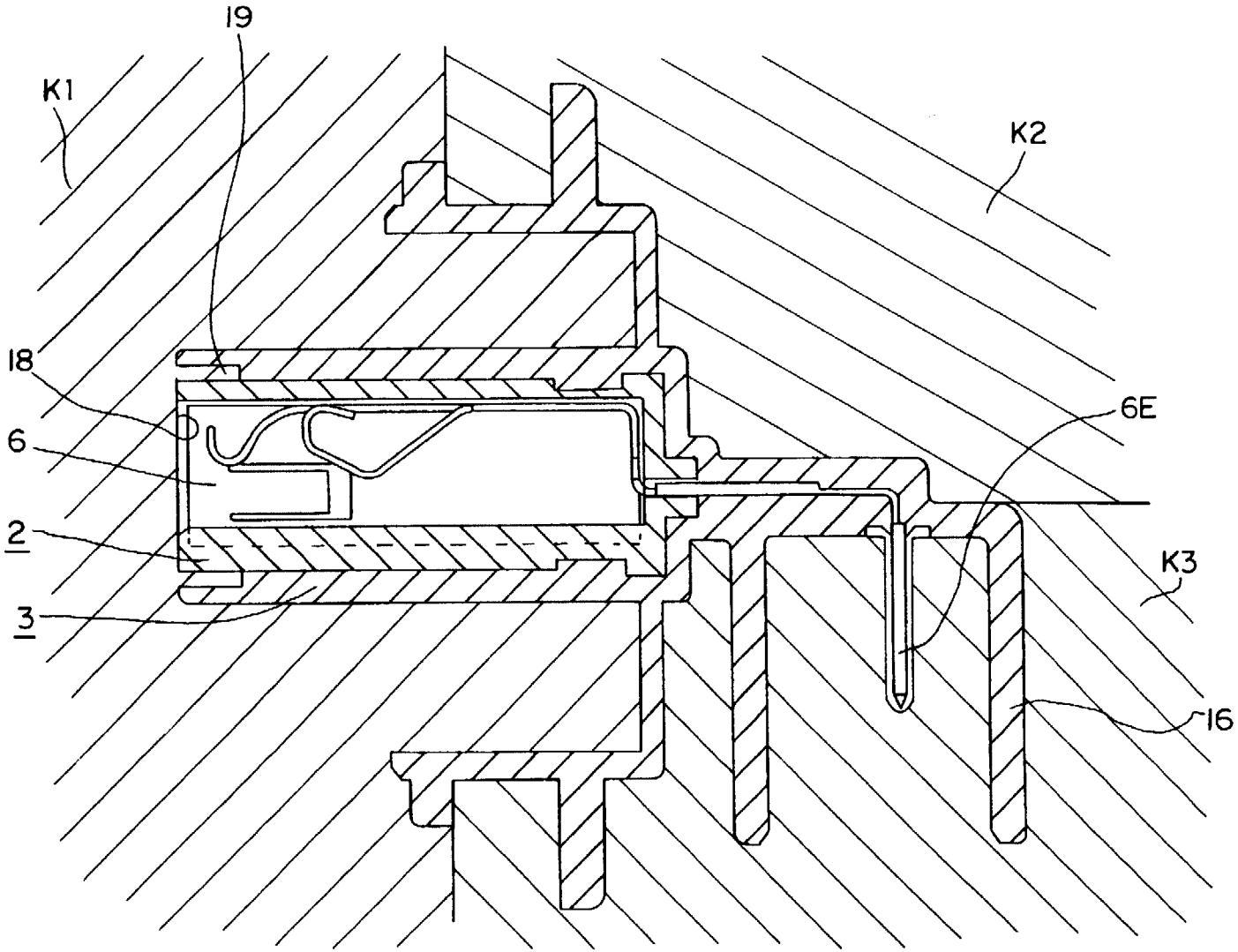
FIG. 7 is a sectional view showing the insert molding of the core in the outer shell, tubular member, and receptacle.

Referring particularly to FIG. 7, core member 2 is inserted into molds K1 to K3 and molten resin is introduced therein (secondary molding). When the mold is opened after curing, insertion port 11 with outer tube 10, cylinder 13 surrounding the tube member 4, and receptacle 16 are all formed. Core member 2 is securely embedded within tubular member 4 and supply 6E is located in receptacle 16.

It should be noted that, during secondary molding, the open periphery of inserting port 5 is closed by mold face 18 of metal mold K1, thereby preventing molten resin from entering tube member 4. In other words, it is only necessary to close the opening of tube member 4, to keep the molten resin out of the cavity in which terminal 6 is located. This is easily accomplished regardless of the shape of metal terminal 6. Accordingly, no complicated element is required to cover the terminal metal fitting 6, thus simplifying the mold structure. As the shape of metal terminal 6 itself is virtually unrestricted, wide flexibility in the design thereof is achieved.

It is a feature of the Invention that the molding face of metal mold K1 has projecting edge 19 which, when the resin is introduced, forms thin groove 12 around the periphery of tubular member 4. This groove, being immediately adjacent member 4, aids in preventing molten resin from leaking therein. Inner flange 9 at the remote end of tubular member 4 is surrounded by the molten resin so that, when the resin has been cured, outer shell 3 is securely united with member 4.

While only a limited number of embodiments have been expressly disclosed, various modifications of the present Invention are included in the technical scope thereof.

(1) Although the description of the Invention has focused on its application to wedge base bulbs, it is useful for connection with any type of electrical unit.

(2) The intermediate portion supply terminal 6E of terminal 6 may be thinned by pressing or the like, so as to facilitate bending.

The present Invention is to be broadly construed and not to be limited except by the character of the claims appended hereto.

What I claim is:

1. A method for the production of an electrical socket comprising an insertion part and, connected thereto, a receptacle, said insertion part having an insertion cavity with an insertion axis, said receptacle having a receptacle cavity with a receptacle axis, said insertion axis and said receptacle axis being at an angle other than 0° and 180° to each other, an electrically conductive terminal comprising an insertion section and a supply contact, said insertion section being in said insertion cavity and adapted to receive and make electrical contact with a first electrical unit, said supply contact being in said receptacle cavity and adapted to make electrical contact with a second electrical unit, said method comprising a primary molding to form a generally tubular member having an open end and a closed end, an insertion hole extending through said closed end, passing said insertion section or said supply contact through said insertion hole so that said insertion section and said supply contact project from said insertion hole in opposite directions, bending said supply contact to form said angle with said insertion section, thereby forming a core member, and secondary molding comprising insertion of said core member into a mold and introducing molding resin therein to form said insertion part and said receptacle.

2. The method of claim 1 wherein said mold has a face which abuts said open end to minimize entry of said resin into said insertion cavity.

3. The method of claim 1 wherein said supply contact has a proximal portion adjacent said insertion hole, a distal portion remote therefrom, and an intermediate portion therebetween, said intermediate portion being more pliant than said proximal portion and said distal portion whereby said bending is facilitated.

4. The method of claim 3 wherein said intermediate portion is thinner than said proximal portion and said distal portion.

5. The method of claim 1 wherein said mold has a projecting edge surrounding an outer surface of said tubular member adjacent said open end to provide a groove, whereby entry of said resin into said insertion cavity is minimized.

* * * * *